US009932750B2

(12) United States Patent
Sabo, Jr.

(10) Patent No.: US 9,932,750 B2
(45) Date of Patent: Apr. 3, 2018

(54) PLATFORM FOR A CEMETERY LOWERING DEVICE

(71) Applicant: Stephen Sabo, Jr., Hamilton, NJ (US)

(72) Inventor: Stephen Sabo, Jr., Hamilton, NJ (US)

(73) Assignee: Stephen Sabo, Jr., Hamilton, NJ (US)

( * ) Notice: Subject to any disclaimer, the term of this patent is extended or adjusted under 35 U.S.C. 154(b) by 0 days.

(21) Appl. No.: 15/416,343

(22) Filed: Jan. 26, 2017

(65) Prior Publication Data

US 2017/0138082 A1 May 18, 2017

Related U.S. Application Data

(63) Continuation-in-part of application No. 14/589,152, filed on Jan. 5, 2015, now Pat. No. 9,567,766.

(60) Provisional application No. 61/924,054, filed on Jan. 6, 2014.

(51) Int. Cl.
*E04H 13/00* (2006.01)

(52) U.S. Cl.
CPC ..... *E04H 13/001* (2013.01)

(58) Field of Classification Search
CPC ..... E04H 13/001; A61G 17/04; A61G 19/00; B66F 7/243; E04G 25/04
USPC ..... 27/29, 30, 32–34; 254/88; 248/354.3
See application file for complete search history.

(56) References Cited

U.S. PATENT DOCUMENTS 441,937 A * 12/1890 Clark ..... E04H 13/001 27/30
646,088 A * 3/1900 Chaffee ..... E04H 13/001 27/30
673,549 A * 5/1901 Spear ..... E04H 13/001 27/29
771,509 A * 10/1904 Temblett et al. ..... E04H 13/001 27/29
961,994 A * 6/1910 Aken ..... E04H 13/001 27/30
1,253,812 A * 1/1918 Graham ..... E02D 29/12 27/17
1,686,048 A * 10/1928 Thompson ..... A61G 17/04 27/30
1,730,289 A * 10/1929 Parker ..... E04H 13/00 27/30
1,755,170 A * 4/1930 Baker ..... A61G 19/00 27/32
1,773,391 A * 8/1930 Cooney ..... A61G 17/04 27/30

(Continued)

*Primary Examiner* — William Miller

(57) ABSTRACT

A platform for a cemetery lowering device comprising a base having a tapered edge and a non-skid surface, wherein the base comprises an opening for a casket to be lowered through the base, a frame and skin, and one or more adjustable-height footings. The frame and skin may be formed of a single piece of polymer, fiberglass, or metal. The skin may be removably attached to the frame. The non-skid surface may comprise grooves. The base may comprise a guide for positioning the cemetery lowering device on the base. The guide is an impression in a surface of the base. The base may comprise a first flange around a perimeter of the opening extending vertically from a top surface of the base. Each one of the adjustable-height footings is threaded such that height adjustments of the one of the adjustable-height footings comprise rotating the one of the adjustable-height footings.

9 Claims, 14 Drawing Sheets

(56) References Cited

U.S. PATENT DOCUMENTS

| | | | | | |
|---|---|---|---|---|---|
| 1,861,560 | A * | 6/1932 | Wickstrum | A61G 17/04 | 27/29 |
| 2,147,858 | A * | 2/1939 | Parker | E04H 13/001 | 27/30 |
| 2,263,087 | A * | 11/1941 | Hamm | E04H 13/001 | 27/30 |
| 2,284,993 | A * | 6/1942 | Simmons | E04H 13/001 | 160/88 |
| 5,001,798 | A * | 3/1991 | Hamilton | E04B 1/34347 | 14/69.5 |
| 5,516,069 | A * | 5/1996 | Hanna | E04F 15/0247 | 248/354.1 |
| 6,102,370 | A * | 8/2000 | Johnston | B60P 3/14 | 254/420 |
| 2005/0161571 | A1* | 7/2005 | Wood | E04G 25/06 | 248/354.3 |

* cited by examiner

PLATFORM FOR A CEMETERY LOWERING DEVICE

PRIORITY CLAIM

This application is a continuation in part of U.S. patent application Ser. No. 14/589,152 filed on Jan. 5, 2015, which claims the benefit of priority to U.S. provisional patent application No. 61/924,054 titled "Platform for a Cemetery Lowering Device" filed on Jan. 6, 2014, which is hereby incorporated herein by reference in its entirety.

BACKGROUND

The present invention relates to cemetery lowering devices and, more particularly, to a platform for a cemetery lowering device. Cemeteries use wood planking to set up a burial site. The planking is set up so the lowering device can sit on top of the already dug grave. The planking usually consists of ten to twelve boards covered with artificial greens. The lowering device sits on the wood planking made up of several different size wood boards. The boards are very un-even and un-safe to stand on when placing the casket on top of the lowering device. When people step up to place a flower on the casket at the end of a funeral service, they usually trip due to the height of the platform and the creases in the artificial green grass that the boards are covered with. When a grave is dug in inclement weather, the vault usually fills up with water, snow or mud and the cemetery employees will have to pump out the grave and vault the next day since they are usually pre-dug at least a day in advance before the burial of the casket and remains.

BRIEF SUMMARY

Methods and systems are provided for a platform for a cemetery lowering device, substantially as illustrated by and/or described in connection with at least one of the figures, as set forth more completely in the claims.

DETAILED DESCRIPTION

As utilized herein, "and/or" means any one or more of the items in the list joined by "and/or". As an example, "x and/or y" means any element of the three-element set {(x), (y), (x, y)}. In other words, "x and/or y" means "one or both of x and y". As another example, "x, y, and/or z" means any element of the seven-element set {(x), (y), (z), (x, y), (x, z), (y, z), (x, y, z)}. In other words, "x, y and/or z" means "one or more of x, y and z". As utilized herein, the term "exemplary" means serving as a non-limiting example, instance, or illustration. As utilized herein, the terms "e.g.," and "for example" set off lists of one or more non-limiting examples, instances, or illustrations.

Figure 1:
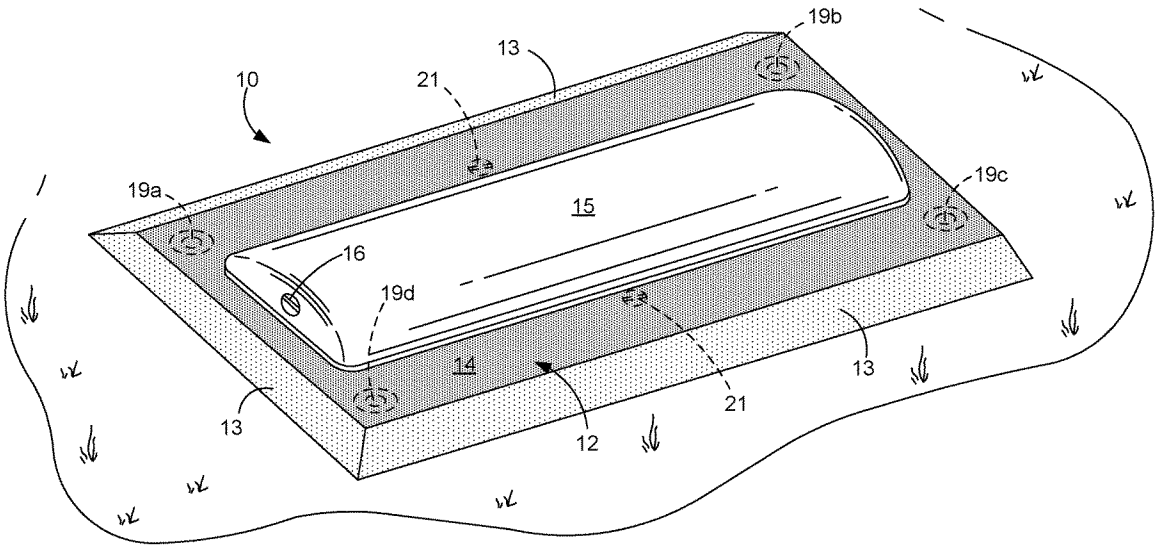
FIG. 1 is a perspective view of a platform in accordance with aspects of this disclosure.
Figure 2:
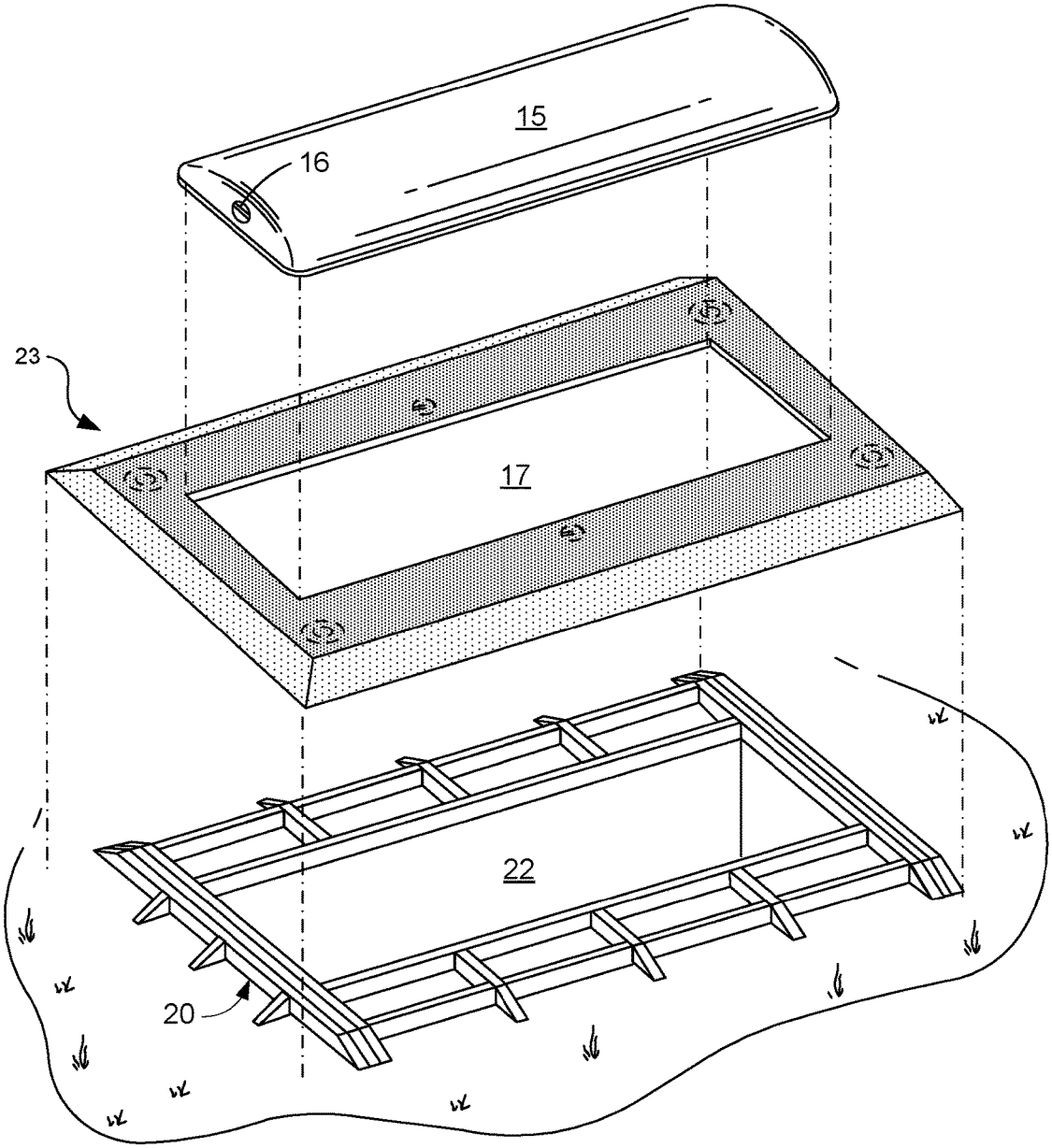
FIG. 2 is an exploded view of the example platform of FIG. 1.
Figure 14A:
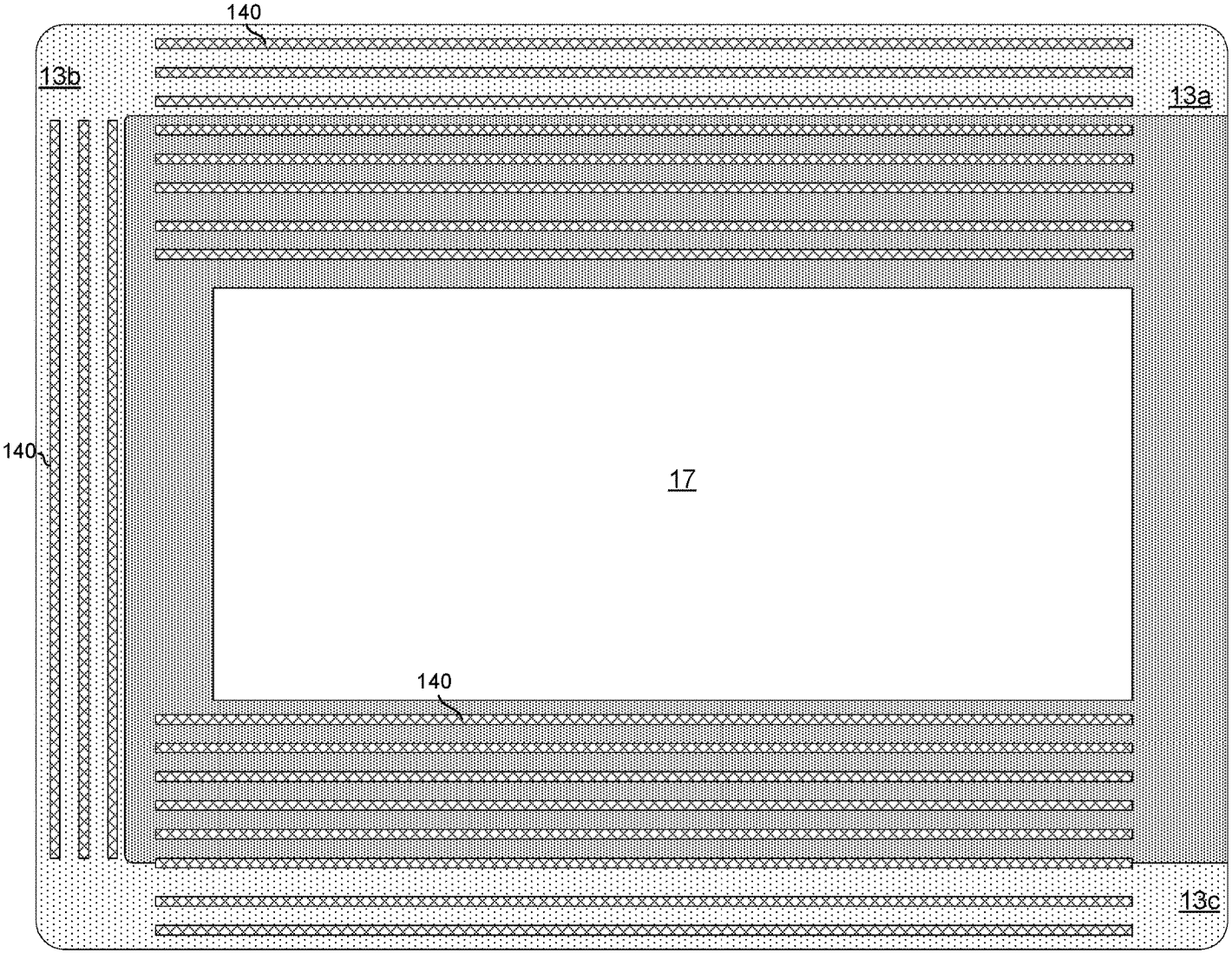
FIG. 14*a* is a top view illustrating non-skid grooves in the base.
Figure 14B:
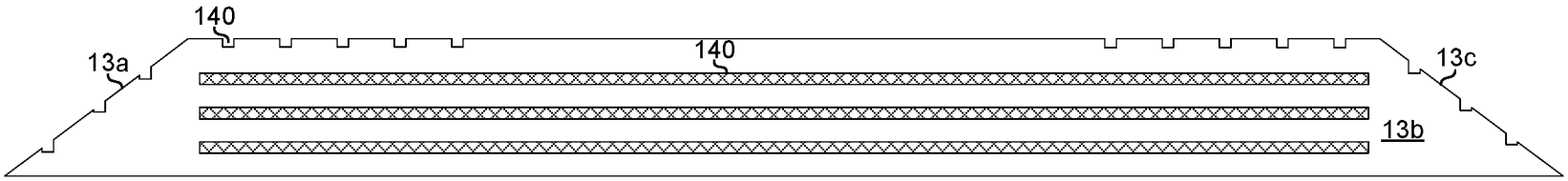
FIG. 14*b* is a side view illustrating non-skid grooves in the base.

Referring to FIGS. 1 and 2, example platform 10 comprises a base 12 and a lid 15. The base 12 comprises a sloped edge 13 that ramps up to a flat surface 14. In the example shown, the sloped edge 13 is on three sides of the rectangular surface 14, with the fourth side (back right side in FIG. 1) being a stepped edge. Each sloped edge may be at an angle of, for example, 30° or 45° or some other angle less than the angle of the stepped edge (which may be, for example, approximately 90°). The surface 14 and edge 13 may be made of, or coated (completely or partially) with a non-skid material (e.g., rubber). Additionally, or alternatively, the surface 14 and edge 13 may be textured (e.g., studded, diamond-plated, etc.) to provide a non-slip surface. The non-skid texturing, coating, and/or material may allow for safe movement around the platform for pall bearers or loved ones that walk up with the casket, to the casket, or are in the process of placing the casket on the lowering device. Referring briefly to FIGS. 14*a* and 14*b*, in an example implementation, skid resistance is provided by grooves 140 (of which only a few are called out for simplicity of illustration) in the surface of the base.

The base 12 has an opening 17 within the approximate center of the surface 14, through which a casket can be lowered into the grave 22 over which the opening 17 is aligned. The base 12 may be made of any suitable material(s).

The base 12 may comprise a frame 20 and skin 23. The frame 20 provides much of the structural support for bearing the load of the casket lowering device, and people walking on the platform 10, while the skin 23 provides a uniform surface for walking on and wheeling the casket lowering device onto the platform 10. The frame 20 may be made of, for example, wood, metal, fiberglass, and/or a polymer (e.g., plastic, rubber, vinyl, etc.) and the skin 23 may be made of, for example, a polymer.

In an example implementation, the frame 20 and skin 23 may be fabricated separately and then joined together. In such an implementation, the skin 23 may be attached to the frame 20 in such a manner that it is not intended to be removed from the frame (e.g., skin 23 may be glued, nailed, stapled, etc. to frame 20), or so the two are separable when removing the platform 10 from a grave site (e.g., through use of wing nuts, buttons, retaining clips, and/or the like).

In another example implementation, the platform 10 comprises one or more pieces where each such piece comprises both at least a portion of frame 20 and at least a portion of skin 23. For example, each such piece may be a single piece of extruded plastic, molded fiberglass, or stamped metal. In such an embodiment, the frame 20 may be, for example, "ribs" or corrugated ridges and grooves integrated with the skin 23 to provide structural rigidity while reducing weight relative to a solid piece of material.

The lid 15 is configured to cover the opening 17 to keep the grave 22 clean, dry, and safe. The lid 15 may comprise one or more handles 16 for transport and movement of the lid 15. The lid 15 may be made of, for example, wood, metal, fiberglass, and/or a polymer (e.g., plastic, rubber, vinyl, etc.).

The base 12 may comprise one or more handles 21 for transport and movement of the base 12.

The base 12 may comprise variable height footings 19 for adjusting the height of the surface 14 (e.g., for leveling and/or stabilizing the surface 14 when placed on uneven ground). In the example shown, there are four footings, each associated with a respective corner of the base 12. Example footings 19 for are described below with reference to FIG. 7. In an example embodiment, the footings 19 may be approximately eight inches from respective sides of the surface 14.

One or both of the base 12 and the lid 15 may comprise a flange such that the lid 15 interlocks with the base 12 for forming a seal between the lid 15 and base 12 when the lid is on/closed.

Figure 3:
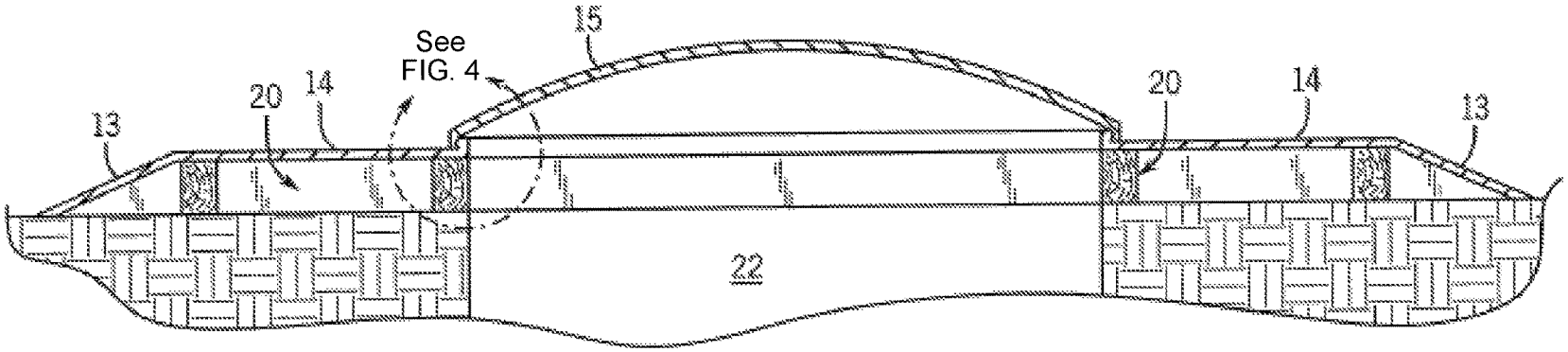
FIG. 3 is a cross-sectional view of the example platform of FIG. 1.
Figure 4:
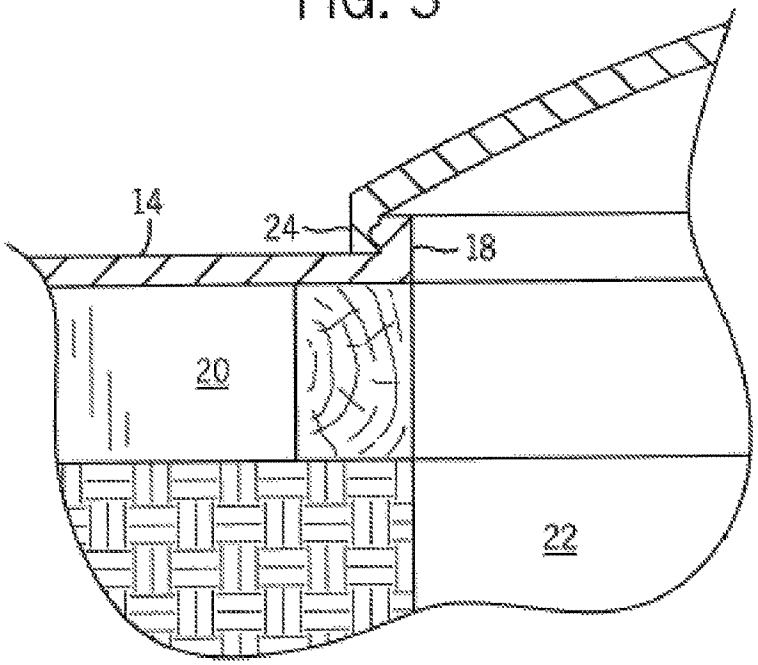
FIG. 4 is a detail cross-sectional view of the mating between lid and platform in the example platform of FIG. 3.

Referring to FIGS. 3 and 4, there is shown an embodiment in which the base 12 comprises a flange 18 which extends vertically from the surface 14. A corresponding flange 24 of the lid 15 fits around the exterior of the flange 18. The flanges 18 and 24 mate to secure the lid 15 to the base 12. For example, one of the flanges 24 and 18 may have a groove and the other of the flanges 18 and 24 may have protruding lip that seats in the groove to, for example, form a substantially water-tight seal, prevents the lid 15 from being blown off by the wind, and/or the like. Additionally, or alternatively, the lid 15 may be somewhat flexible such that it may be stretched/bent to pull over the flange 18 of the base 12 such that an elastic force of the flanges 18 and 24 against one another holds the lid 15 in place.

Figure 5:
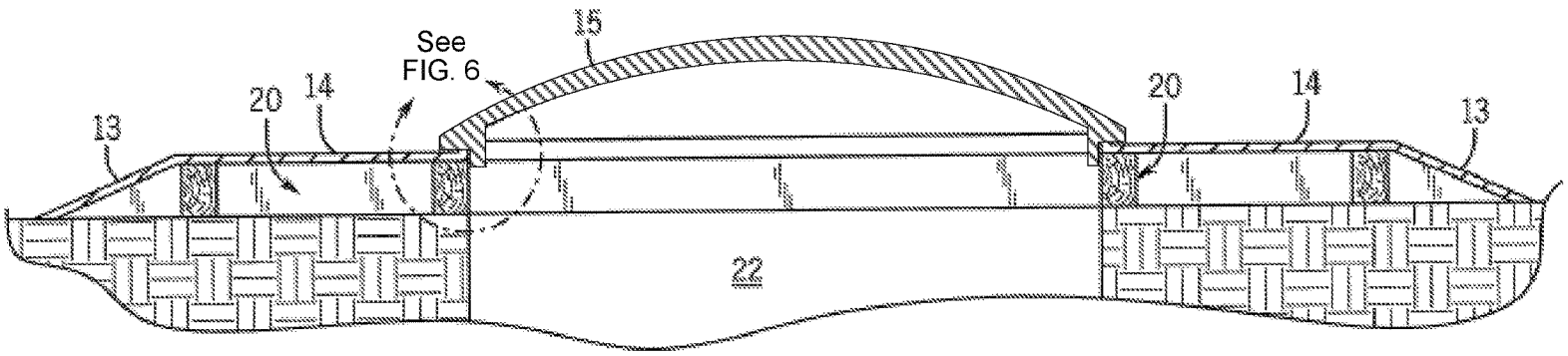
FIG. 5 is a cross-sectional view of the example platform of FIG. 1.
Figure 6:
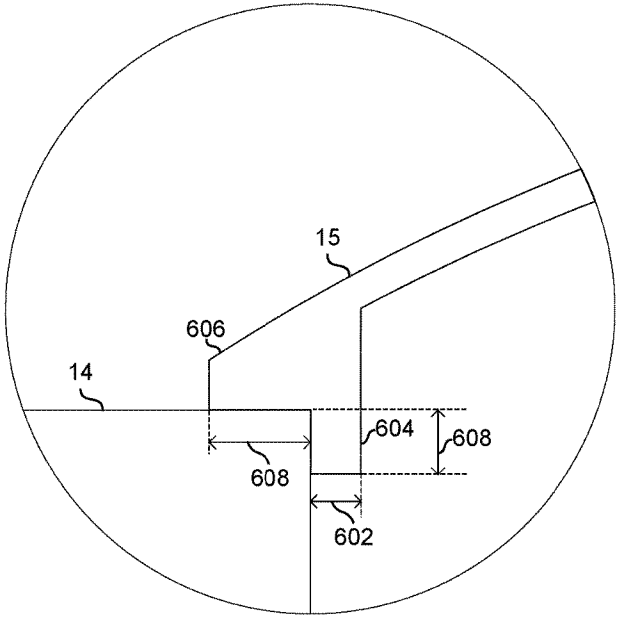
FIG. 6 is a detail cross-sectional view of the mating between lid and platform in the example platform of FIG. 5.

Referring to FIGS. 5 and 6, there is shown an embodiment in which the base 12 does not comprise a flange but the lid 15 comprises a flange 604 of thickness 602 (e.g., 0.75 inches), which extends into the opening 17 by an amount 608 (e.g., 1 inch). In this embodiment, the lid 15 also comprises a shoulder 606 that overlaps the surface 14 by an amount 608 (e.g., 1 inch) to form a substantially water-tight seal. The lid 15 may be somewhat flexible such that it may be compressed/bent to push into the opening 17 such that an elastic force of the flange 604 against the base 12 holds the lid 15 in place to prevent it from blowing off and the like.

Figure 7:
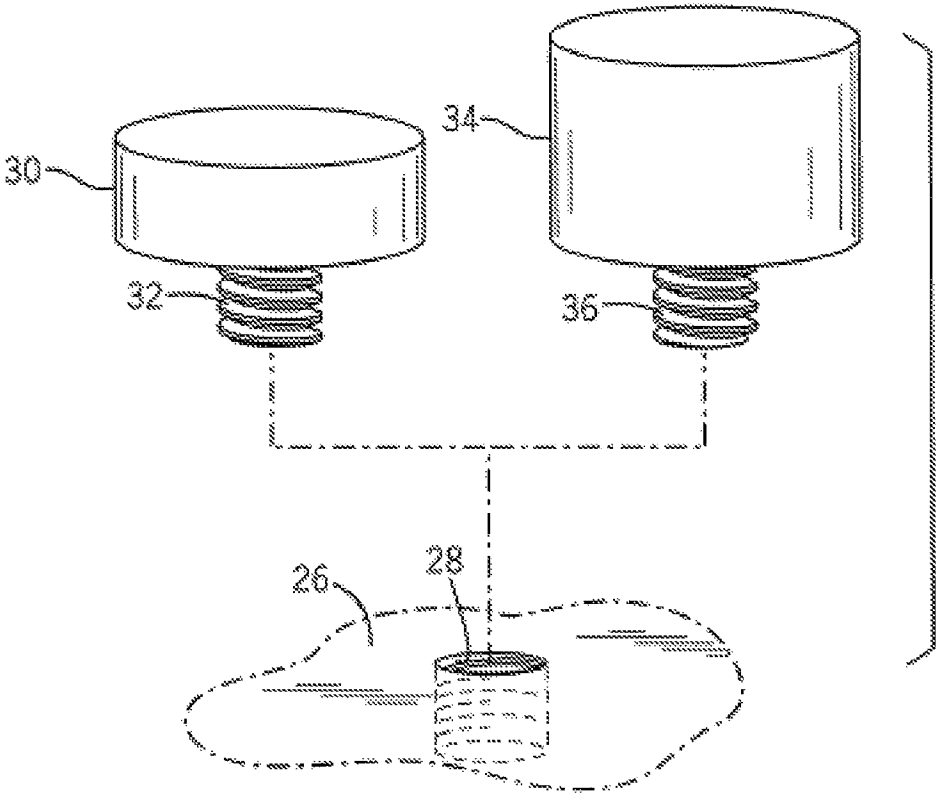
FIG. 7 is an exploded view showing two alternative forms of adjusters for a platform in accordance with aspects of this disclosure.
Figure 10:
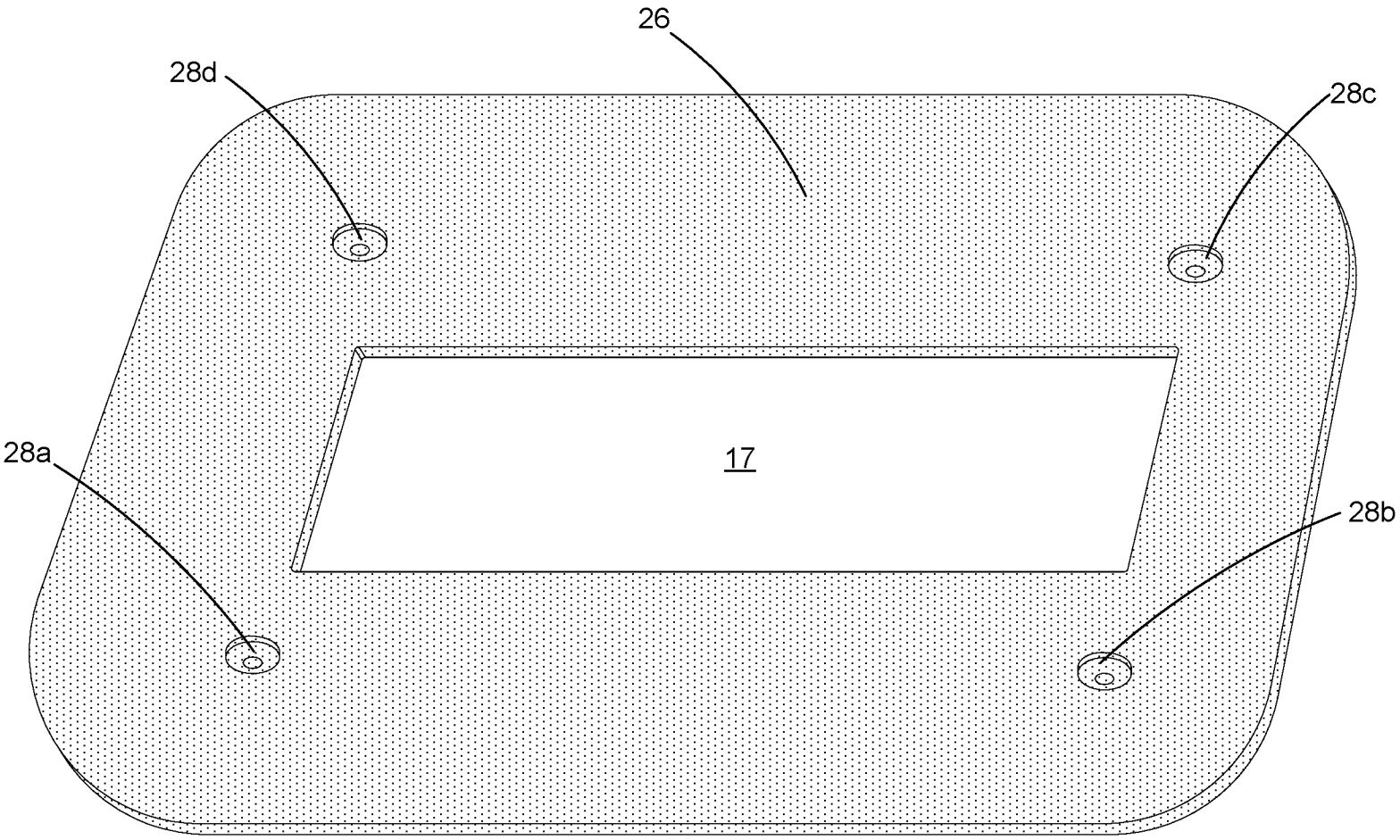
FIG. 10 shows the underside of an example platform in accordance with aspects of this disclosure.

Referring to FIG. 7, there is shown example adjustment footings 30 and 34 each of which may correspond to one or more of the footings 19*a*-19*d* shown in FIG. 1. The example adjustment footings 30 and 34 comprise threaded portions 32 and 36, respectively. The male threaded portions 32 and 36 may screw into a female threaded receptacle 28 in the underside 26 of the base 12 (e.g., as better shown in FIG. 10). When the platform is to be used on uneven ground, footings of appropriate height (e.g., the footing 30 may be 2 inches the footing 34 may be 4 inches) may be screwed into the appropriate receptacle to achieve a substantially level surface. To provide an amount of height adjustment that is between the heights of available footing, a shorter footing may be only partially screwed in (e.g., using a lock nut to prevent the footing from spinning (and raising or lowering) while the platform 10 is in use.

Figure 8A:
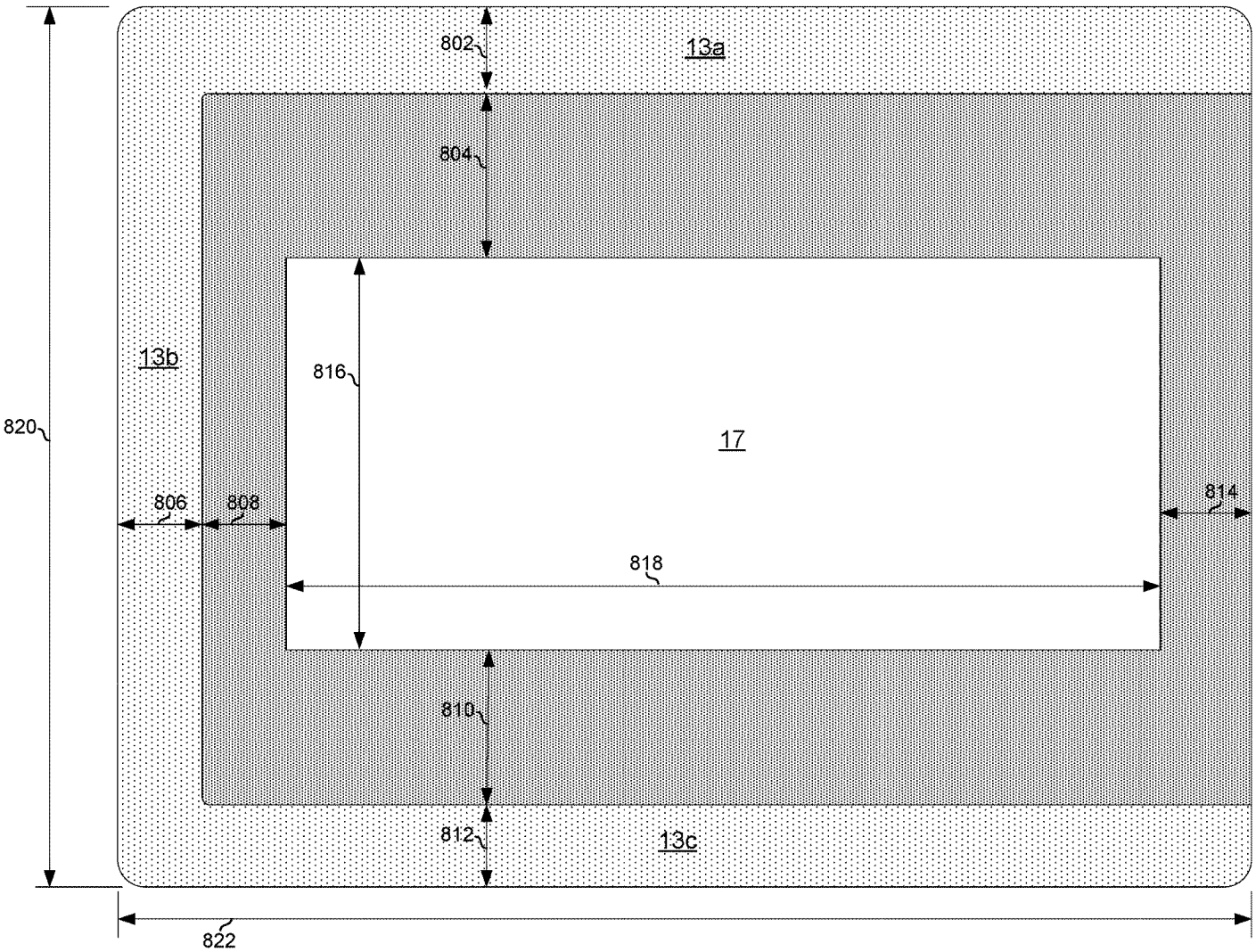
FIG. 8A is a top view illustrating dimensions of an example platform in accordance with aspects of this disclosure.
Figure 8B:
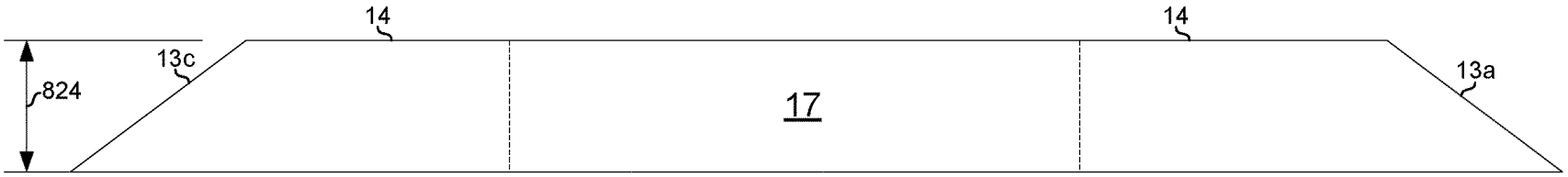
FIG. 8B is a side view illustrating dimensions of an example platform in accordance with aspects of this disclosure.

FIG. 8A is a top view illustrating dimensions of an example platform in accordance with aspects of this disclosure. In this example embodiment, side 13*a* is of width 802 (e.g., 8 inches), side 13*b* is of width 806 (e.g., 8 inches), side 13*c* is of width 812 (e.g., 8 inches), a width of surface 14 between opening 17 and side 13*a* is distance 804 (e.g., between 1 and 2 feet, such as 1 foot, 6 inches or 1 foot, 3 inches), a width of surface 14 between opening 17 and side 13*b* is distance 808 (e.g., less than a foot, such as 8 inches or 6 inches), a width of surface 14 between opening 17 and side 13*c* is distance 810 (.g., between 1 and 2 feet, such as 1 foot, 6 inches or 1 foot, 3 inches), a width of opening 17 is distance 816 (e.g., between 3 and 4 feet, such as 3 feet, 4 inches or 3 feet, 2 inches) and a length of opening 17 is a distance 818 (e.g., between 7 and 8 feet, such as 7 feet, 8 inches), a width of surface 14 between opening 17 and edge 13*d* is distance 814 (e.g., less than a foot, such as 8 inches or 6 inches), an overall width of platform 10 is distance 820 (e.g., between 7 and 8 feet, such as 7 feet or 7 feet, 8 inches), and an overall length of platform 10 is distance 822 (e.g., between 9 and 10 feet such as 9 feet, 8 inches or 9 feet, 4 inches). As shown in FIG. 8B, the height of the platform 10 may be distance 824 (e.g., less than 6 inches such as 3 inches).

Figure 9:
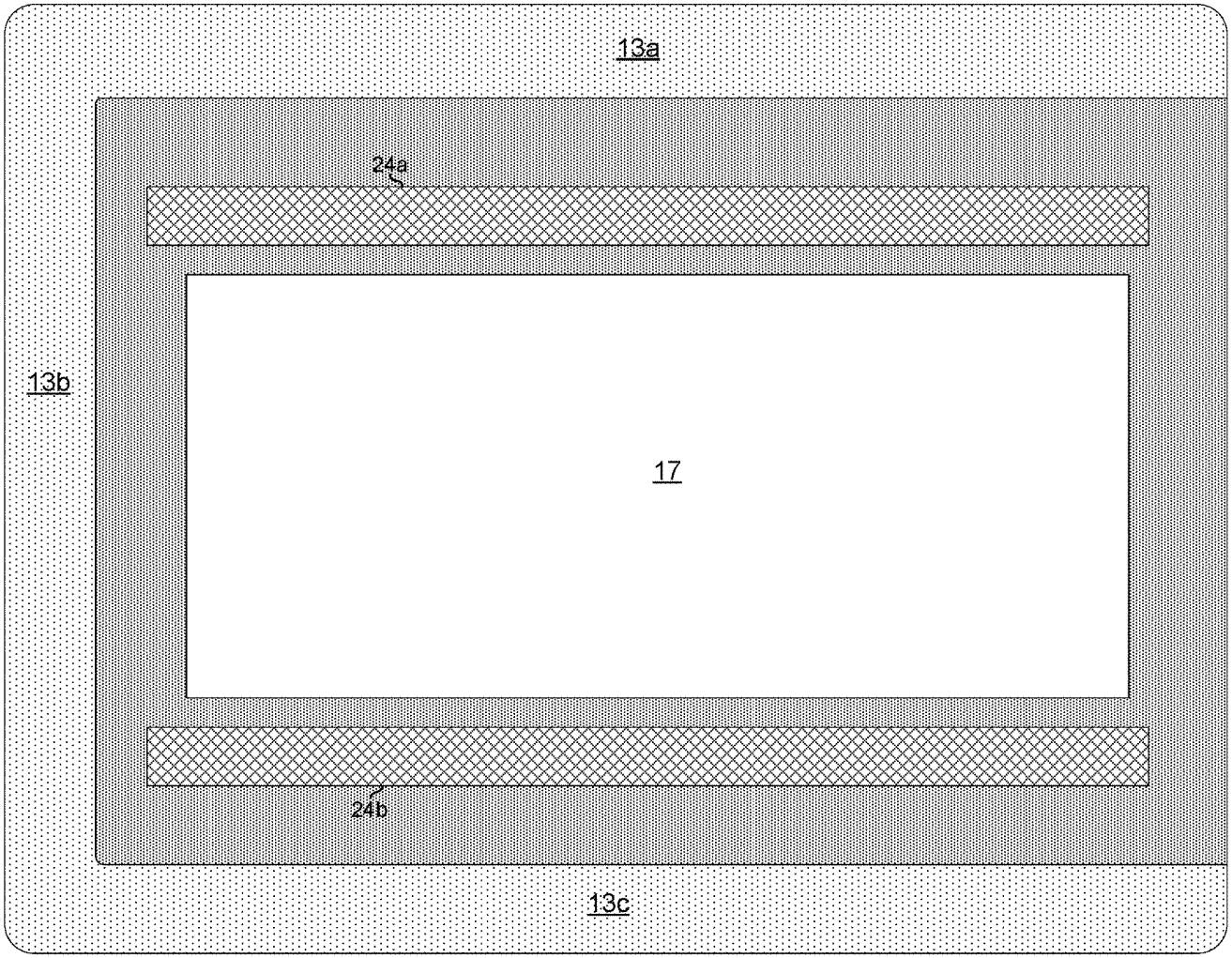
FIG. 9 is a top view of an example platform with guides for positioning a casket lowering device and/or holding the casket lowering device in place.

FIG. 9 is a top view of an example platform with guides for positioning a casket lowering device and/or holding the casket lowering device in place. The guides 24*a* and 24*b* may, for example, comprises track-like impressions in the surface 14 that guides wheels on the casket lowering device as it is rolled onto the platform 10. The guides 24*a* and 24*b* may comprise, for example, a plurality of impressions in the surface 14 in which feet or wheels of the casket lowering device rest when it is properly positioned over the opening 17.

In an example implementation, the guides 24*a* and 24*b* may comprise, for example, raised guides or stops that hold the wheels of the casket lowering device rest in place so that it is properly positioned over the opening 17. In such an implementation, the guides or stops may comprise pegs that fit into holes on the surface 14. There may be a plurality of possible holes for each guide (e.g., the surface 14 may have a regular grid of holes) such that the position of the guides can be adjusted for different casket lowering device footprints.

Figure 11:
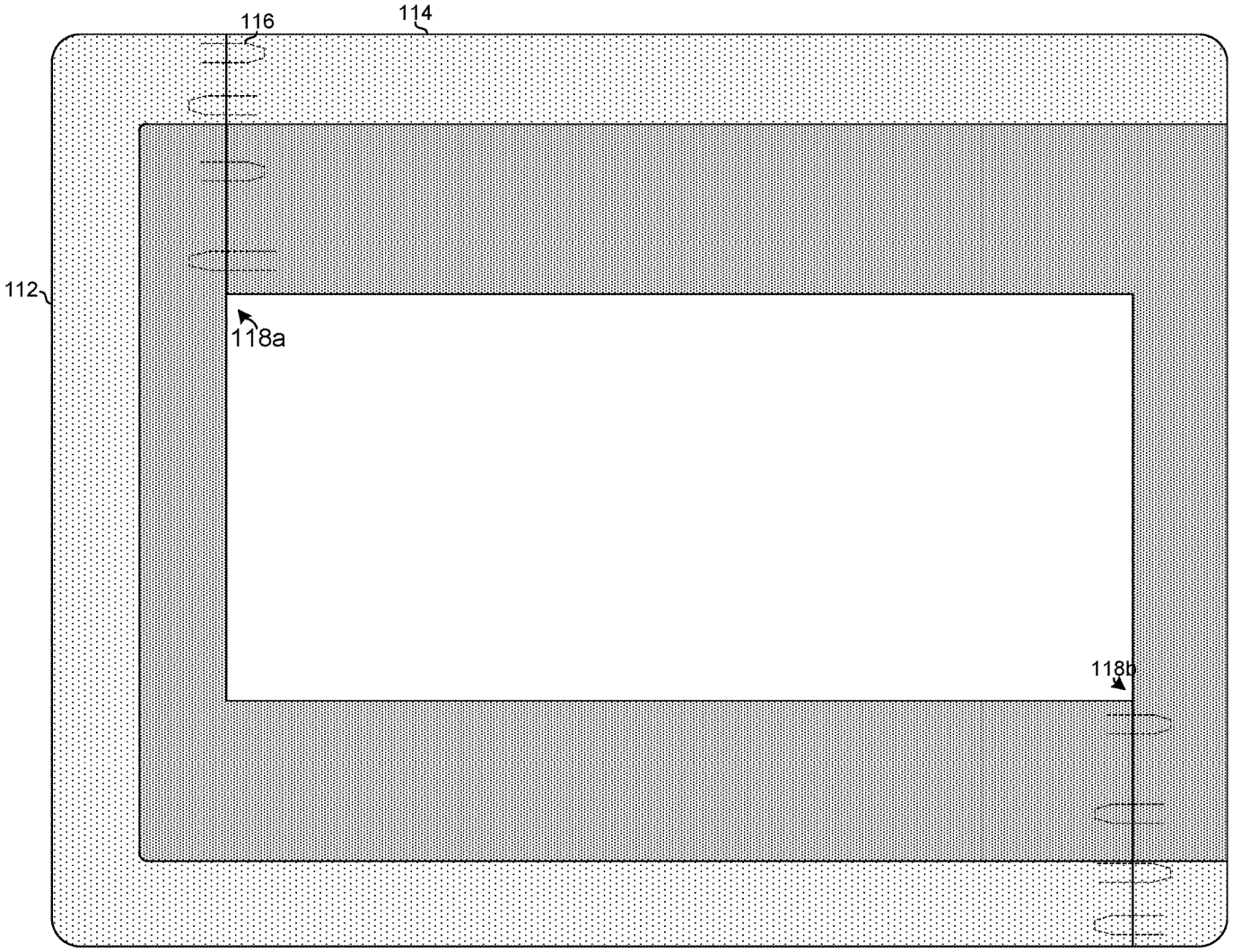
FIG. 11 shows a top view of a modular implementation of an example platform in accordance with aspects of this disclosure.

FIG. 11 shows a top view of a modular implementation of an example platform in accordance with aspects of this disclosure. In the example implementation shown, the platform 10 comprises two pieces 112 and 114 which may be coupled via coupling elements 116. In this manner, the pieces 112 and 114 may be separated for transport and storage of the platform 10 and then joined when installing the platform 10 at a gravesite. When the pieces 112 and 114 are connected to each other, the coupling elements 116 may provide support transverse to the joints 118*a* and 118*b* between the two pieces 112 and 114 so as to provide structural support at the joints between the two pieces (e.g., to maintain a substantially level surface 14). The coupling elements 116 may be releasable coupling elements such that the pieces 112 and 116 may be connected and disconnected using only one's hands, without need for any tools. For example, the coupling elements 116 may comprise, pins with retaining clips, drawbolts/pull latches, and/or the like.

Figure 12:
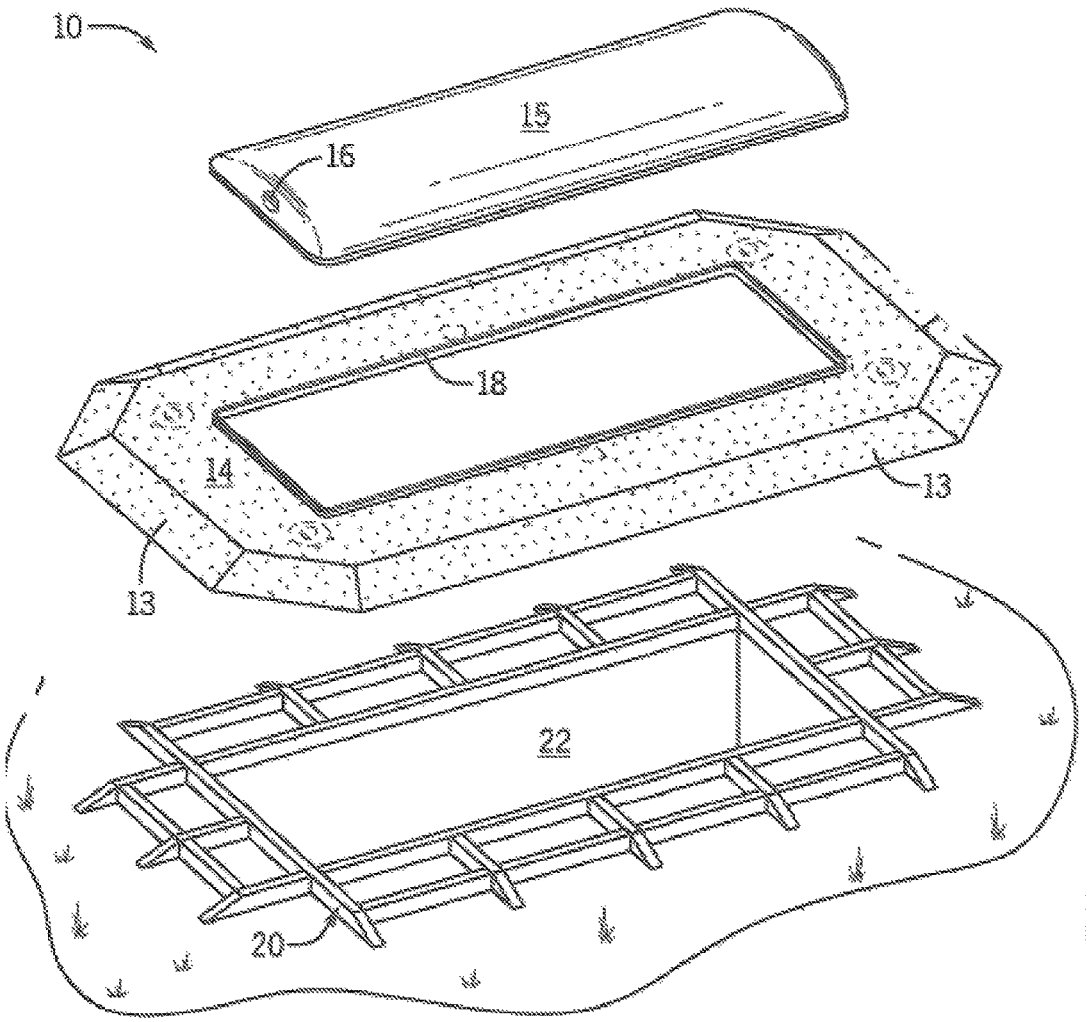
FIG. 12 is an exploded view of another example platform in accordance with aspects of this disclosure.
Figure 13:
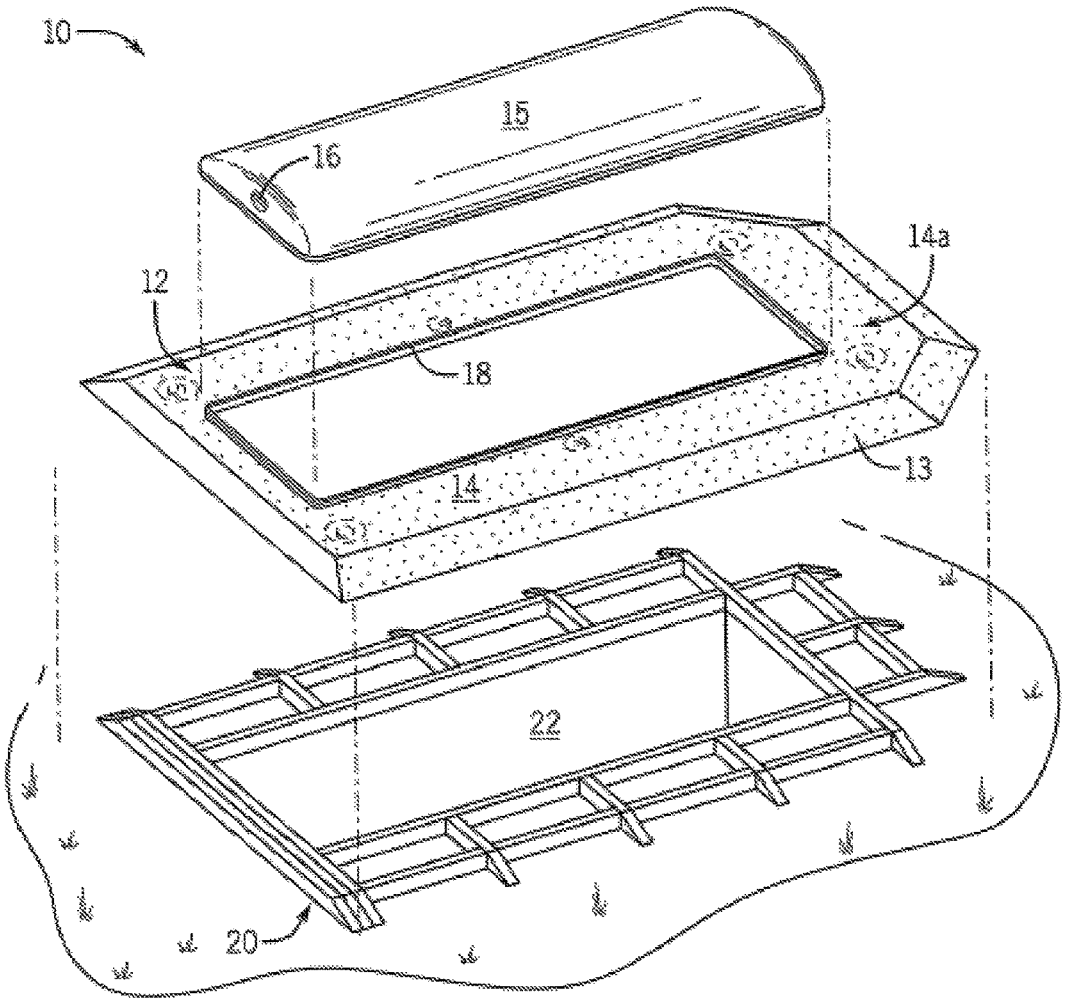
FIG. 13 is an exploded view of still another example platform in accordance with aspects of this disclosure.

FIG. 12 is an exploded view of another example platform in accordance with aspects of this disclosure. In the example implementation shown in FIG. 12, the platform 10 is octagonal in shape (as compared to the substantially rectangular, or rounded rectangular, embodiment shown in FIGS. 1-11). FIG. 13 is an exploded view of still another example platform in accordance with aspects of this disclosure. In the example implementation shown in FIG. 12, the platform 10 is in the shape of an asymmetric hexagon. Other shapes are of course possible.

In accordance with an example implementation of this disclosure, a platform (e.g., 10) for a cemetery lowering device comprises a base (e.g., 12) and a lid (e.g., 15). The base has tapered edges (e.g., 13), a non-skid surface (e.g., surfaces of 13 and 14), and an opening (e.g., 17) within the approximate center of the base for a casket to be lowered through the base. The lid is configured to be removably secured to the base and, when secured to the base, cover the opening. The platform may comprise one or more receptacles (e.g., 28) for attaching variable-height footings (e.g., 30 and 34). The base may comprise a frame (e.g., 20) and a skin (e.g., 23), wherein the skin is removably attached to the frame or wherein the frame and skin are formed from a single piece of polymer, fiberglass, metal, composite wood, or other material. The platform may comprise a guide (e.g., 24*a* or 24*b*) for positioning a casket lowering device on the platform. The guide may be an impression in a surface (e.g., 14) of the platform. The platform may comprise a plurality of pieces which are releasably coupled together via one or more coupling elements (e.g., 116). The base may comprise a first flange (e.g., 18) around a perimeter of the opening, wherein the first flange extends vertically from a top surface of the base. The lid may comprise a second flange (e.g., 24) that surrounds the first flange when the lid is secured to the base. The lid may comprise a flange (e.g., 604) that extends into the opening when the lid is secured to the base. The lid may comprise a shoulder (e.g., 606) that extends over a top surface of the base when the lid is secured to the base.

While the present method and/or system has been described with reference to certain implementations, it will be understood by those skilled in the art that various changes may be made and equivalents may be substituted without departing from the scope of the present method and/or system. In addition, many modifications may be made to adapt a particular situation or material to the teachings of the present disclosure without departing from its scope. Therefore, it is intended that the present method and/or system not be limited to the particular implementations disclosed, but that the present method and/or system will include all implementations falling within the scope of the appended claims.

What is claimed is:

1. A platform for a cemetery lowering device comprising:

a base having a tapered edge and a non-skid surface, wherein the base comprises:

an opening for a casket to be lowered through the base;

a frame and skin;

one or more adjustable-height footings; and a first flange around a perimeter of the opening, wherein the first flange extends vertically from a top surface of the base for mating with a corresponding flange of a lid of the cemetery lowering device.

2. The platform for a cemetery lowering device of claim 1, wherein the frame and skin are formed of a single piece of polymer.

3. The platform for a cemetery lowering device of claim 1, wherein the frame and skin are formed of a single piece of fiberglass.

4. The platform for a cemetery lowering device of claim 1, wherein the frame and skin are formed of a single piece of metal.

5. The platform for a cemetery lowering device of claim 1, wherein the skin is removably attached to the frame.

6. The platform for a cemetery lowering device of claim 1, wherein the non-skid surface comprises grooves.

7. The platform for a cemetery lowering device of claim 1, wherein the base comprises a guide for positioning the cemetery lowering device on the base.

8. The platform for a cemetery lowering device of claim 7, wherein the guide is an impression in a surface of the base.

9. The platform for a cemetery lowering device of claim 1, wherein each one of the adjustable-height footings is threaded such that height adjustments of one of the adjustable-height footings comprise rotating the one of the adjustable-height footings.

* * * * *